United States Patent [19]

Couturier

[11] 4,221,122

[45] Sep. 9, 1980

[54] VEHICLE BODY AND CHASSIS STRAIGHTENING APPARATUS

[76] Inventor: Alain Couturier, 37, rue du Professeur Patel, Lyon, France

[21] Appl. No.: 963,287

[22] Filed: Nov. 24, 1978

[30] Foreign Application Priority Data

Nov. 25, 1977 [FR] France ..... 77 36453

[51] Int. Cl.[3] ..... B21D 1/12; B21D 1/14; B21J 13/04

[52] U.S. Cl. ..... 72/455; 72/705

[58] Field of Search ..... 72/705, 455, 456, 483, 72/462

[56] References Cited

U.S. PATENT DOCUMENTS

| | | | |
|---|---|---|---|
| 2,542,836 | 2/1951 | Porter et al. | 72/705 X |
| 2,559,250 | 7/1951 | Jackson | 72/705 X |
| 2,705,040 | 3/1955 | Howick | 72/705 X |
| 2,717,020 | 9/1955 | Dobias | 72/705 X |
| 3,034,563 | 5/1962 | Gaspar et al. | 72/705 X |
| 3,214,959 | 11/1965 | Bowden | 72/705 X |
| 3,501,938 | 3/1970 | Sprague | 72/705 X |
| 4,003,239 | 1/1977 | Step | 72/705 X |
| 4,023,394 | 5/1977 | Borup | 72/705 X |
| 4,088,002 | 5/1978 | Andrew | 72/705 X |
| 4,138,876 | 2/1979 | Chisum | 72/705 X |

FOREIGN PATENT DOCUMENTS

| | | | |
|---|---|---|---|
| 255547 | 4/1964 | Australia | 72/705 |
| 2077776 | 5/1971 | France | 72/705 |
| 1011759 | 12/1965 | United Kingdom | 72/705 |

*Primary Examiner*—Ervin M. Combs
*Assistant Examiner*—D. M. Gurley
*Attorney, Agent, or Firm*—Karl F. Ross

[57] ABSTRACT

A vehicle-repair apparatus has a floor-mounted generally rectangular track having two long and two short sides that are spaced apart sufficiently to accept a vehicle within the sides. A long portal having a pair of upright leg members and a cross member spans the track between the short sides and a similar short portal spans it between the long sides. These portals can be moved perpendicularly to each other along the respective sides. It is possible to lock each of the legs at the respective side to the track, and to lock the cross members of the portals together. A support can be secured to any of the legs or cross members and a jack in turn can be secured to it to pull or push out a dent in a vehicle standing within the track.

9 Claims, 5 Drawing Figures

VEHICLE BODY AND CHASSIS STRAIGHTENING APPARATUS

Field of the Invention

The present invention relates to an apparatus for straightening the body and chassis of a vehicle. More particularly this invention concerns such an apparatus employed in a body shop for repairing vehicle accident damage and the like.

Background of the Invention

It is a standard practice in the preliminary stages of vehicle body and chassis repair to straighten out the worst damage by means of hydraulic jacks that are braced between fixed locations outside the vehicle or interior parts of the vehicle and used to return dented or otherwise damaged parts to their original positions. In fact it is frequently possible for an able repairman in this manner to pull or push out most of the more serious dents, so that afterwards these areas can be filled and repainted with ease.

Although it is standard practice in many smaller shops merely to position the vehicle relative to a substantial support, such as a heavy pillar, so that the jack can be braced between the support and the area to be acted on, in larger installations it is known to have a special arrangement for supporting and holding the body-repair jacks. Thus, for example, U.S. Pat. No. 4,003,239 describes a complex cage structure into which the vehicle is driven and which has a plurality of fixed horizontal and vertical members anchored together to form a rigid superstructure to which vehicle frame and the chassis straightening tools can be secured. Such an arrangement provides a multiplicity of locations to which these tools can be secured, yet nonetheless often requires the operator to reposition the vehicle so that the tools can be effective with a predetermined angle of attack, or to be satisfied with a less than optimum positioning of the tools. Such an arrangement takes up considerable space, which space is normally not usable for other purposes.

It has also been suggested in French Pat. No. 2,077,776 to provide a heavy horizontal rail surrounding the vehicle on at least three sides. The straightening jack can be secured at any location to this rail. Thus the positioning of the tool in a horizontal plane can be varied within considerable limits. Nonetheless vertical repositioning is almost entirely impossible. At the same time this heavy rail makes access to the vehicle difficult for other repair jobs, so that once again a special bay must be set aside for use of the straightening tool alone.

Objects of the Invention

It is therefore an object of the instant invention to provide an improved vehicle-repair apparatus.

Another object is the provision of such an apparatus which allows the body-repair jack to be anchored so that it can assume virtually any possible angle of attack with respect to the vehicle.

Another object is to provide such an apparatus which can be produced at relatively low cost, and which at the same time does not take up an inordinate mount of space when not in use.

Summary of the Invention

These objects are attained according to the present invention in an apparatus that stands on a floor-mounted generally rectangular track having a pair of generally parallel spaced longitudinal sides and a pair of parallel transverse sides. These sides are spaced apart sufficiently to accept the vehicle for repair between themselves. A longitudinally extending portal having a pair of upright leg members and a cross member connecting these leg members together and a transversely extending portal of similar design are supported at their leg members respectively on the transverse and longitudinal sides of the track for transverse and longitudinal displacement therealong. Each of the leg members can be locked to the respective track and the cross members can also be rigidly locked together. A support can be secured to at least some of the members and a jack for body or chassis repair can be mounted on the support and engageable with the body of the vehicle under the portals. These portals lie in and define respective and substantially perpendicular upright longitudinal and transverse planes.

Thus with the apparatus according to the instant invention it is possible to position the one end of the jack at virtually any location around the vehicle, with the anchor point movable both vertically and horizontally all around the vehicle. The other end of the jack can therefore be brought to bear at any location on the vehicle in any desired direction and can operate both for pulling or pushing. As the only above-ground structure is the two portals and the support, it is possible for this apparatus to be moved almost completely out of the way when not in use. This is most easily achieved by providing the apparatus in a corner, so that when not in use the one portal can be moved all the way over against one wall and the other portal all the way against the adjacent wall. Thus once the major dent pulling and pushing operation is over it is possible to displace the apparatus out of the way and continue working on the vehicle in the very same repair bay.

According to further features of this invention the members are of nonround section, preferably square or rectangular, and the support for the jack includes a sleeve of complementary section which can surround any of the members and can be locked at any location therealong. To this end the sleeve can be hinged along one corner and provided with a latch at the diagonally opposite corner so that it can be closed on any of the leg members or any of the cross members, and is provided with an eye or other anchor point for the outer end of the jack. In addition the sleeve is provided with a tightening member, simply in the form of a diagonally effective screw, to lock it on whichever member it is fitted to. These members may all be hollow and of relatively light, yet simultaneously very rigid, construction. In this manner the apparatus can be produced at relatively low cost, yet will nonetheless provide a very firm anchoring for the straightening jack.

According to other features of this invention the track is formed of a pair of lips, each constituted by a flange of an angle iron. These lips define a vertically open slot through which extends the piston rod of a fluid-operated actuator that is housed below the floor underneath the slot-forming lips. In addition each of the legs rides via rollers on these angle irons, but the rollers are resiliently mounted so as to be laterally deflectible. Thus when the fluid-operated actuator underneath the floor on each of the leg members is operated these rollers are deflected and a friction element on the lower end of the leg members bears against the upper surface of the lips, while the actuator bears against the lower surface thereof to lock the respective portal tightly in place.

At each intersection of a cross member with another cross member, as more than one longitudinal or transverse portal can be employed, a locking arrangement is provided which comprises, according to the instant invention, three superposed relatively thick plates, a lower plate below the lower cross member, an intermediate plate between the two crossing cross members, and an upper plate over the upper cross member. The upper and intermediate plate are provided with downwardly expansible fluid-operated actuators which can be pressurized to press against the upper surfaces of the respective cross members, thereby drawing the lower plate up against the lower cross member. This action locks the cross members together at their crossing point. Of course two actuators could also be provided on the upper surfaces of the lower and intermediate plates for the same effect. Vertical tie rods flanking the respective cross members interconnect the plates, with the upper pair of tie rods lying in a plane perpendicular to that of the lower pair of tie rods.

Specific Description

Figure 1:
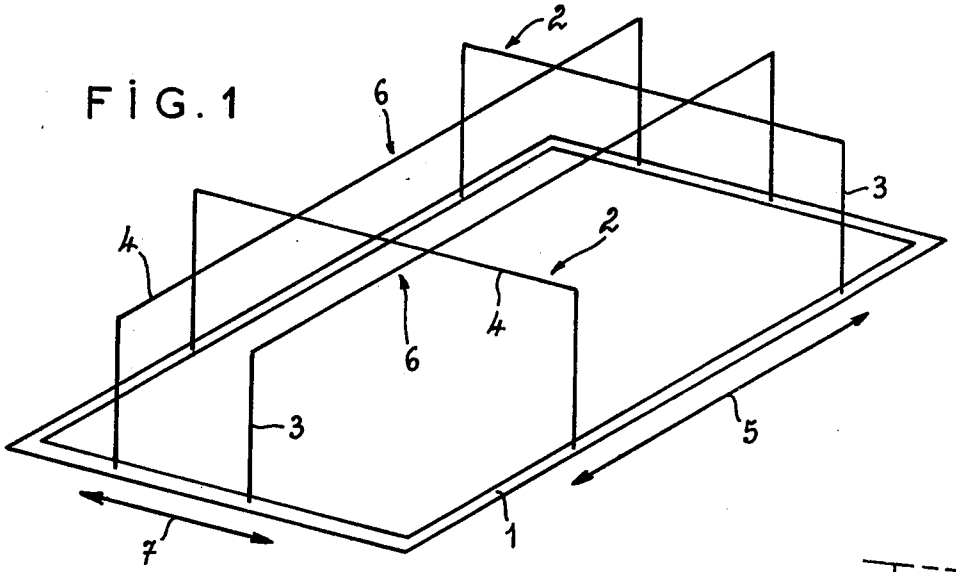
FIG. 1 is a diagrammatic and perspective view of the system according to this invention.

As shown in FIG. 1 according to this invention the system basically comprises a floor-mounted rectangular track 1 on which is mounted a pair of transverse portals 2 each having a pair of leg members 3 interconnected by a cross member 4 so as to be downwardly U-shaped. These transverse portals 2 are displaceable longitudinally as shown by arrow 5 on the track 1. In addition the system has a pair of longitudinal portals 6 each also formed of a pair of legs 3 and a cross member 4 but displaceable transversely as indicated by double-headed arrow 7. The portals 2 are somewhat taller than the portals 6 so that the cross members 4 of the portals 2 pass over the cross members 4 of the portals 6.

Figure 3:
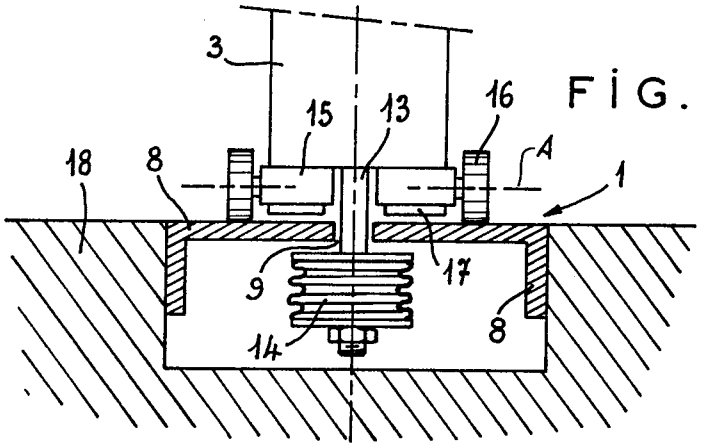
FIG. 3 is a large-scale vertical section through the track at one of the leg members of the system of this invention.
Figure 2:
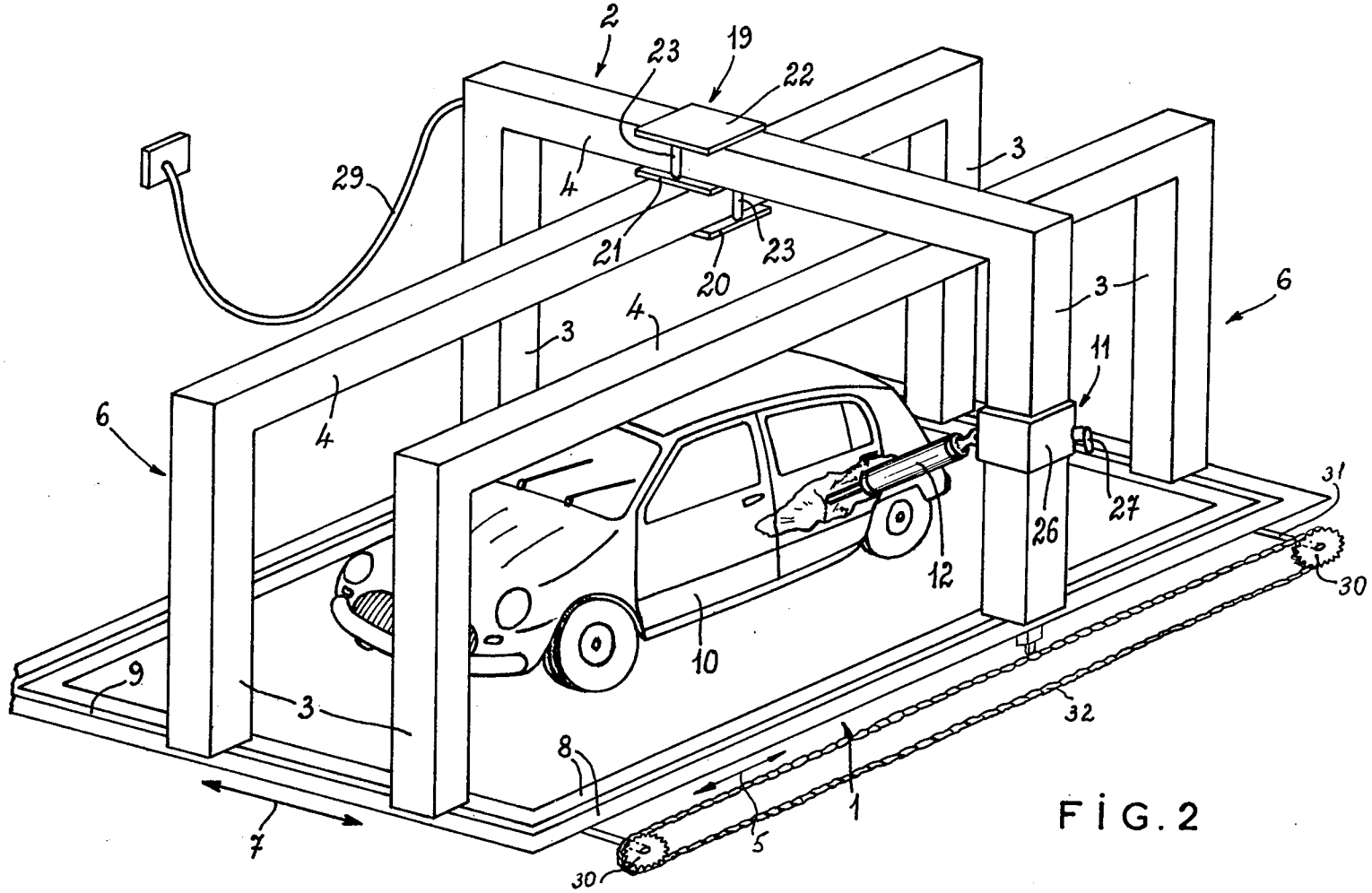
FIG. 2 is a perspective view of the system according to this invention with a vehicle in place.

As shown in more detail in FIG. 3 the track 1 is formed along each of its longitudinal transverse sides by a pair of angle irons 8 defining a slot 9 and lying level with the normally concrete floor 18. The legs 3 are supported on the upper surfaces of the horizontal flanges of the angle irons 8. The sides of the track 1 extending in the longitudinal direction 5 are longer than the vehicle 10 as shown in FIG. 2, while the transverse sides extending in the direction 7 are also wide enough for this vehicle 10. A double-acting hydraulic jack 12 can be secured to a support 11 that itself can be fastened to any of the legs 3 or cross members 4 as also shown in FIG. 2.

The lower end or foot of each of the legs 3 can be secured relative to the track 1 as shown in FIG. 3. To this end a rod 13 extending downwardly from each of the legs 3 passes through the slot 9 and is connected at its lower end to a plate constituting one end of a bellows or fluid actuator 14 whose upper end is formed by a plate that can be brought to bear by pressurization of the interior of the bellows 14 on the lower surfaces of the horizontal flanges of the angle irons 8. Each leg 3 furthermore rides via rollers 16 secured for rotation about axes A in deflectible mounts 15. Underneath each of these mounts 15 is a friction-type floor-engaging element 17. Pressurization of the interior of the bellows 14 brings its upper plate to bear against the lower surfaces of the track 1 and causes the mount 15 to deflect so that the wheels 16 tip up and the elements 17 come to bear directly against the track 1. This action will lock the respective leg 3 immovably with respect to the track 1. In addition each of the legs 3 is connected as shown in FIG. 2 to an endless cable 32 spanned between a pair of pulleys 30 carried on axles 31 that each extend to the other side of the installation and are similarly connected via a cable 32 to the lower end of the other leg of the respective portal. In this manner when the actuators 14 of a portal are depressurized an operator can merely push the one leg 3 of the portals so as automatically to displace it in the desired direction. As illustrated the members 3 and 4 of the portals 2 and 6 are of square section and are hollow so that although they are extremely rigid they nonetheless are relatively light and easy to move.

Figure 4:
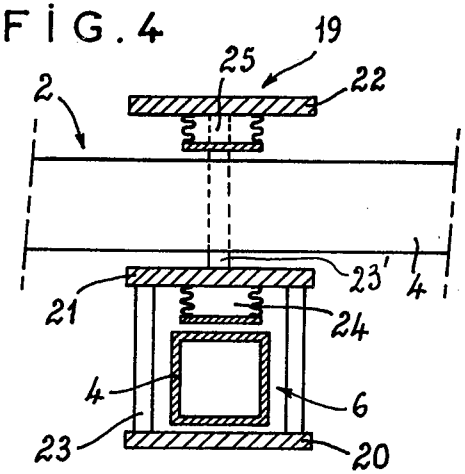
FIG. 4 is a large-scale section through the intersection of the cross members according to this invention.

As shown in FIG. 4 at the intersection of the cross members 4 there is provided a locking arrangement 19 constituted by a lower plate 20, an intermediate plate 21 and an upper plate 22. Tie rods 23 connect the lower plate 20 to the intermediate plate 21 and flank the cross members 4 of the longitudinal portal 6 and similar such rods 23' flanking the cross member 4 of the transverse portal 2 connect the intermediate plate 21 to the upper plate 22. Bellows-type fluid actuators 24 and 25 are mounted on the lower surfaces of the plates 21 and 22 and are engageable with the upper surfaces of the cross members 4 of the respective portals 2. Pressurization of these two actuators 24 and 25 through a conduit 29 shown in FIG. 2 therefore presses them against the upper surfaces of the respective cross members, bringing the lower plate 20 up against the lower surface of the lower cross member 4 to lock the two cross members 4 together at their intersection. When not energized the cross members can slide relative to each other with the arrangement 19 remaining at the intersection.

Figure 5:
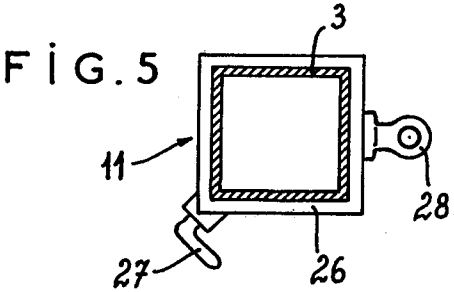
FIG. 5 is a horizontal section through one of the leg members above the support for the jack of this invention.

FIG. 5 shows that the support 11 is constituted as a square-section sleeve 26 carrying at one diagonal corner a screw-type lock 27 and in the middle of one of its faces an eye 28 to which the jack 12 can be secured. This sleeve 26 may be provided also along one face but at one corner with a hinge and in the diametrically opposite face or corner with a latch so that it can be opened up and positioned on any of the members 3 or 4.

Thus with the system according to the instant invention the portals 2 and 6 can be positioned so that the support 11, which in turn can be positioned along any of the portals 2 and 6, can be brought to bear on any location of the vehicle 10 located under and between the portals 2 and 6. The use of only two portals provides considerable rigidity, although two longitudinal portals as shown in FIG. 2 can be used to allow several jacks 12 to be operated at the same time, and to achieve increased rigidity. In all cases locking arrangements 19 are provided at all of the intersections of the cross members 4. The various fluid actuators 14, 24, and 25 can all be operated easily with compressed air, as their large surface areas allow even relatively reduced pressure to be sufficient to hold them tightly in place. The cylinder 12 is, however, hydraulic and double-acting. Furthermore means is normally provided, such as floor-mounted eyes that are connected to the car or other vehicle by means of chains, to hold the vehicle 10 tightly in place during straightening.

When not in use it is a relatively simple procedure to slide the portals 2 and 6 to the end of the respective sides of the track. This completely frees most of the work area so that a vehicle 10 can be moved in or out or otherwise worked on with no difficulty. Thus the system according to this invention when not in use takes up very little floor space.

I claim:

1. A vehicle-repair apparatus comprising:

a floor-mounted generally rectangular track havng a pair of generally parallel spaced longitudinal sides and a pair of generally parallel transverse sides, said sides beng spaced apart sufficiently to accept a vehicle for repair between themselves;

a longitudinally extending portal having a pair of upright leg members and an upper cross member connecting said leg members together;

a transversely extending portal having a pair of upright leg members and an upper cross member connecting the respective leg members together, said portals being generally planar in respective upright and substantially perpendicular longitudinal and transverse planes;

means supporting said leg members of said longitudinal and transverse portals respectively on said transverse and longitudinal sides of said track for transverse longitudinal displacement therealong;

means at each of said leg members for locking same to the respective side;

means on said cross members for releasably rigidly locking same together and thereby arresting said portals on said track;

a support securable to at least some of said members; and a body-repair jack mountable on said support and engageable with the body of a vehicle under said portals.

2. The apparatus defined in claim 1 wherein said support includes means for securing it to any of said members at any location therealong.

3. The apparatus defined in claim 2 wherein said members are of nonround section and said support includes a sleeve of nonround section surrounding one of said members.

4. The apparatus defined in claim 1 wherein the leg support means includes at least one roller on each of said leg members supporting same on said track.

5. The apparatus defined in claim 4 wherein the leg locking means each includes a deflectable mount for the respective roller, an element on the respective leg member engageable with said track, and means for deflecting the respective roller and pressing the respective element against said track.

6. The apparatus defined in claim 1 wherein said track has a lip with an upper surface and a lower surface, the leg locking means each including a clamping elements and a fluid-operated actuator for pressing the respective elements against said lower surface.

7. The apparatus defined in claim 6 wherein said track has a pair of such lips defining a gap, said elements and said actuators being below said lips.

8. The apparatus defined in claim 1 wherein the means on said cross members includes respective longitudinal and transverse clamping plates slidable along the cross members of said longitudinal and transverse portals, an upright bar linking said plates together for joint horizontal displacement, and fluid actuators for clamping said plates against the respective cross members.

9. The apparatus defined in claim 1 wherein said jack is double-acting.

* * * * *